US007963492B2

(12) United States Patent
Nevins

(10) Patent No.: US 7,963,492 B2
(45) Date of Patent: Jun. 21, 2011

(54) VERTICAL SUPPORT STRUCTURE

(75) Inventor: Scott A. Nevins, Gettysburg, PA (US)

(73) Assignee: EVAPCO, Inc., Westminster, MD (US)

( * ) Notice: Subject to any disclaimer, the term of this patent is extended or adjusted under 35 U.S.C. 154(b) by 453 days.

(21) Appl. No.: 12/033,493

(22) Filed: Feb. 19, 2008

(65) Prior Publication Data

US 2009/0205805 A1 Aug. 20, 2009

(51) Int. Cl.

| | |
|---|---|
| ***A47B 96/06*** | (2006.01) |
| ***E04G 3/00*** | (2006.01) |
| ***E04G 5/06*** | (2006.01) |
| ***F16B 1/00*** | (2006.01) |
| ***G09F 7/18*** | (2006.01) |
| ***A47F 5/00*** | (2006.01) |
| ***A47K 1/00*** | (2006.01) |
| ***A47K 5/00*** | (2006.01) |

(52) U.S. Cl. ..... 248/225.11; 248/235; 248/247; 248/309.1; 248/227.4; 248/227.3; 211/189; 211/191; 165/68; 165/67

(58) Field of Classification Search ..... 248/200, 248/235, 247, 309.1, 227.4, 225.11, 227.3, 248/225.21; 211/189, 191; 165/68, 67
See application file for complete search history.

(56) References Cited

U.S. PATENT DOCUMENTS

| | | | | |
|---|---|---|---|---|
| 3,804,357 | A * | 4/1974 | Robinett et al. | 248/553 |
| 4,613,929 | A * | 9/1986 | Totten | 362/150 |
| 4,879,800 | A * | 11/1989 | Rumman | 29/450 |
| 5,967,690 | A * | 10/1999 | Tibbetts | 402/73 |
| 7,147,115 | B2 * | 12/2006 | Perkins et al. | 211/94.01 |
| 7,322,551 | B2 * | 1/2008 | Simonsen | 248/231.81 |
| 7,694,925 | B2 * | 4/2010 | Kokenge et al. | 248/220.42 |
| 2005/0040301 | A1 * | 2/2005 | Walter | 248/200 |

* cited by examiner

*Primary Examiner* — Terrell McKinnon
*Assistant Examiner* — Christopher Garft
(74) *Attorney, Agent, or Firm* — Rader, Fishman & Grauer PLLC

(57) ABSTRACT

A vertical support structure includes a mounting plate and a support member. The support member has a vertically-elongated central panel and a pair of vertically-elongated side panels connected to and extending perpendicularly from the central panel to form a U-shaped-channel as viewed in cross-section. The support member has a top edge and a bottom edge disposed vertically apart from and extending horizontally parallel to one another. The support member has a slot formed at least through the central panel. The slot is disposed between and extends parallel to the top and bottom edges. The mounting plate is slidably inserted into the slot in a close-fitting manner and is connected to the support member such that the mounting plate at least partially projects perpendicularly from the central panel away from the U-shaped channel. A guide element is connected to the top edge and extends upwardly and inwardly toward the U-shaped channel.

18 Claims, 8 Drawing Sheets

VERTICAL SUPPORT STRUCTURE

FIELD OF THE INVENTION

The present invention relates to a vertical support structure. More particularly, the present invention is directed to a vertical support structure adapted for use with a heat exchanger.

BACKGROUND OF THE INVENTION

A conventional heat exchanger 100 is described in U.S. Pat. No. 6,923,250 and illustrated in FIGS. 1A-4. The conventional heat exchanger 100 includes a cabinet 102 that houses an exhaust fan 104, a manifold 106, a direct heat exchanger medium 108 and a plurality of louver modules 110. As is commonly known in the art, the manifold 106 supplies water via spray nozzles 112 in a spray form to the direct heat exchanger medium 108 while the exhaust fan 104 draws air represented by the solid single-line arrows from outside the cabinet 102 through the louver modules 110. As the sprayed water flows downwardly along the direct heat exchanger medium 108 and as air is drawn upwardly by the exhaust fan 104 through the direct heat exchanger medium 108, heat is effectively exchanged between the downwardly flowing water and the upwardly moving air. After heat has been exchanged, the water drips into and accumulates in a water basin 113.

In FIG. 1A, the cabinet 102 includes a plurality of side walls 102*a* that house the direct heat exchanger medium 108. The plurality of side walls 102*a* rest on respective ones of cross-beams 114. As best shown in FIG. 1B, the cross-beam 114 rests on a support assembly 116. Each cross-beam 114 is generally C-shaped and has a pair of facially-opposing flanges 114*c* and 114*c*, a web 114*d* disposed between and connected to the facially-opposing flanges 114*c* and 114*c* and a pair of ribs 114*e* and 114*e* extending from respective ones of the pair of flanges 114*c* and 114*c*. The support assembly 116 includes a vertical support beam 118 and a resting plate 120 having a plurality of resting plate holes 120*a* as best shown in FIGS. 2 and 3. The resting plate 120 is connected to the top of the vertical support beam 118 by a weldment 122 in a manner that the resting plate holes 120*a* are positioned in front of the vertical support beam 118.

As best shown in FIG. 1B, cross-beam flange holes 114*b* are formed in respective ones of the flanges 114*c* of the cross-beams 114 that rest on the resting plate 120. When the cross-beams 114 are resting on the resting plate 120, the cross-beam flange holes 114*b* correspond with the resting plate holes 120*a* so that the cross-beams 114 are fastened to the resting plate 120 by conventional fasteners, such as nuts 124*a* (FIG. 4) and bolts 124*b* (FIGS. 1B and 4).

As illustrated in an exaggerated manner in FIG. 4 only for the purpose of clearly and easily understanding a drawback in the prior art, specific load conditions, particularly during seismic events or in heavy wind conditions, exerted on the heat exchanger 100 can be problematic. During such seismic events or heavy wind conditions, a load, shown by way of example as an arrow, is exerted on the cabinet that, in turn, causes shear $F_S$ and tension $F_T$ forces along with a bending moment $M_B$ to develop and be exerted on the connected nuts 124*a* and bolts 124*b* fastening the flange 114*c* of the cross-beam 114 to the resting plate 120. The connected nuts and bolts 124*a* and 124*b* resist practically the entirety of such shear $F_S$ and tension $F_T$ forces along with the developed bending moment $M_B$. As illustrated in this exaggerated manner, the bolt 124*b* is subjected to the various forces and moments as the applied seismic or wind load is transmitted from the unit center of gravity, through the joint, to the base of the structure.

It would be beneficial to provide a vertical support structure that reduces the shear $F_S$ and tension $F_T$ forces along with the bending moment $M_B$ that is generated during seismic events and/or in heavy wind conditions on the nuts and bolts fastening the flange of the cross-beam to the resting plate by redistributing the forces and moments away from the nuts and bolts. It would also be beneficial to provide a vertical support structure that provides enhanced support for cross-beams in a heat exchanger. Additionally, it would be beneficial to provide a vertical support structure that would simplify mating of a top section of the heat exchanger to the bottom section thereof. The present invention provides these benefits.

OBJECTS AND SUMMARY OF THE INVENTION

It is an object of the invention to provide a vertical support structure that reduces the shear $F_S$ and tension $F_T$ forces along with the bending moment $M_B$ generated during seismic events and/or windy conditions on the nuts and bolts fastening the flange of the cross-beam to the resting plate.

It is another object of the invention to provide a vertical support structure that provides enhanced support for cross-beams in a heat exchanger.

Yet another object of the invention is to provide a vertical support structure that would simplify mating of a top section of the heat exchanger to the bottom section thereof.

Accordingly, a vertical support structure of the present invention is hereinafter described. A first embodiment of a vertical support structure of the present invention includes a mounting plate and a support member. The support member extends vertically along a vertical axis and has a vertically-elongated central panel and a pair of vertically-elongated side panels connected to and extending perpendicularly from the central panel to form a U-shaped-channel as viewed in cross-section. The support member has a top edge and a bottom edge disposed vertically apart from and extending horizontally parallel to one another. The support member has a slot formed at least through the central panel. The slot is disposed between and extends parallel to the top and bottom edges. The mounting plate is slidably inserted into the slot in a close-fitting manner and is connected to the support member such that the mounting plate at least partially projects perpendicularly from the central panel away from the U-shaped channel.

A second exemplary embodiment of a vertical support structure includes a support member as described above and a guide element. The guide element is integrally connected to the top edge of the central panel and extends upwardly and inwardly toward the U-shaped channel.

A third exemplary embodiment of a vertical support structure of the present invention includes a mounting plate, a support member and a guide element, as described above, in combination with each other.

More specifically, the exemplary embodiments of the vertical support structure of the present invention are adapted for connecting at least one cross-beam thereto. The at least one cross-beam has a flange and a web connected perpendicularly to the flange with the flange having at least one cross-beam flange hole formed therethrough and the web having at least one cross-beam web hole formed therethrough. The vertical support structure includes a plurality of fasteners, a support member and a mounting plate.

These objects and other advantages of the present invention will be better appreciated in view of the detailed description of the exemplary embodiments of the present invention with reference to the accompanying drawings, in which:

DETAILED DESCRIPTION OF THE EXEMPLARY EMBODIMENTS

Hereinafter, embodiments of the present invention will be described with reference to the attached drawings. The structural components common to those of the prior art and the structural components common to respective embodiments of the present invention will be represented by the same symbols and repeated description thereof will be omitted.

Figure 1A:
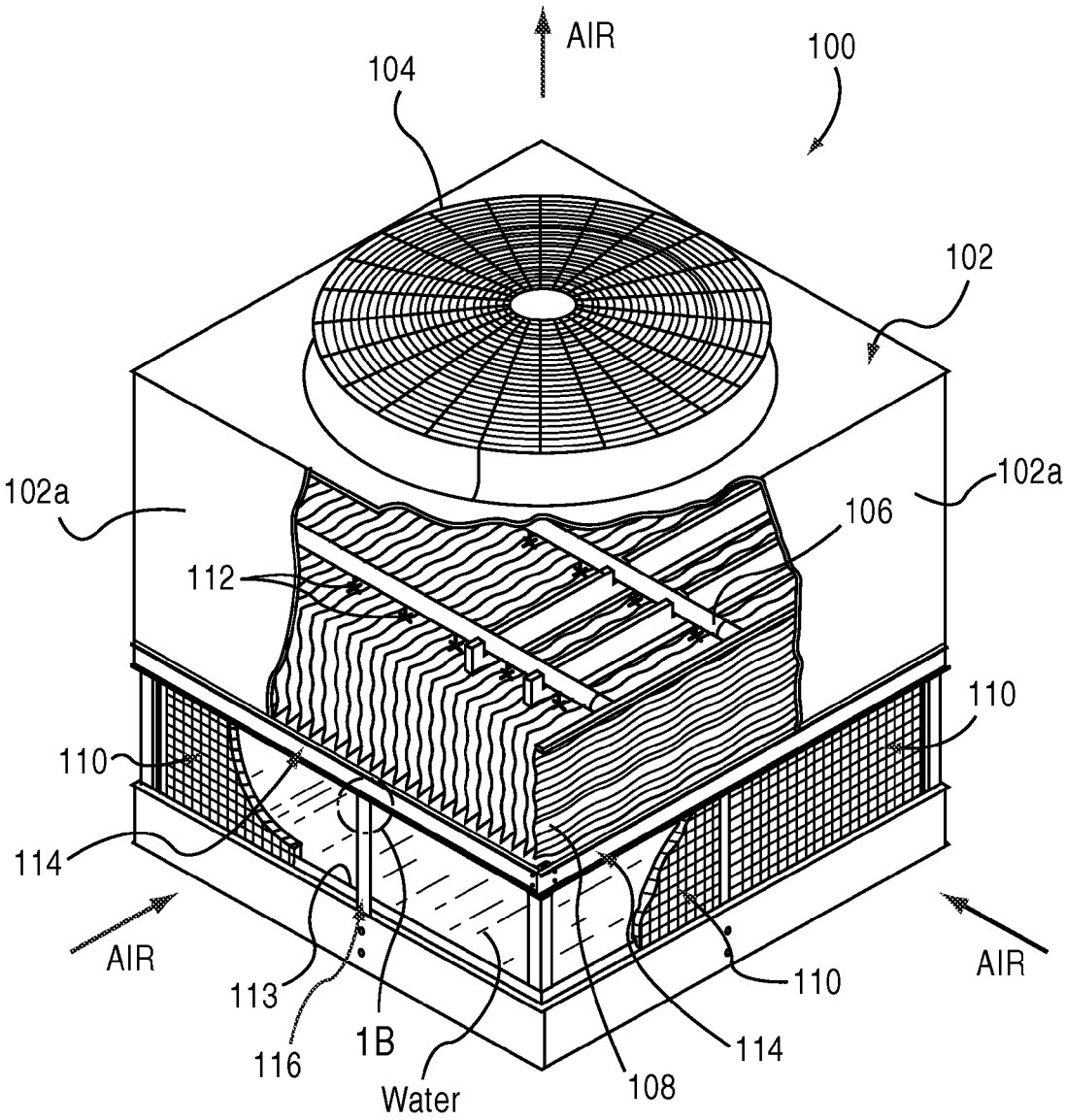
FIG.1A PRIOR ART
FIG. 1A is a perspective view of a conventional heat exchanger.
Figure 1B:
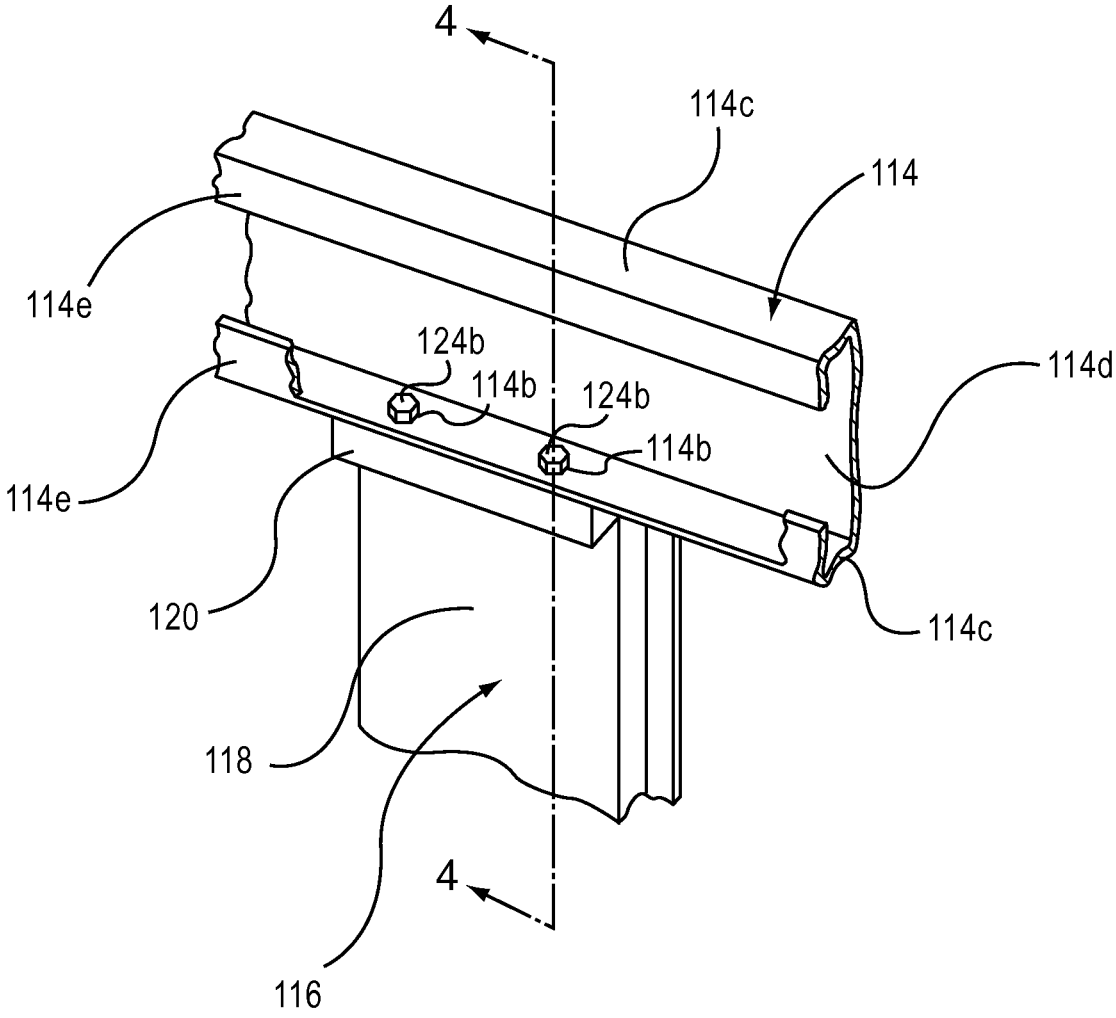
FIG.1B PRIOR ART
FIG. 1B is an enlarged partial perspective view of an arrangement of a cross-beam supported by a conventional support assembly in the conventional heat exchanger in FIG. 1A.
Figure 2:
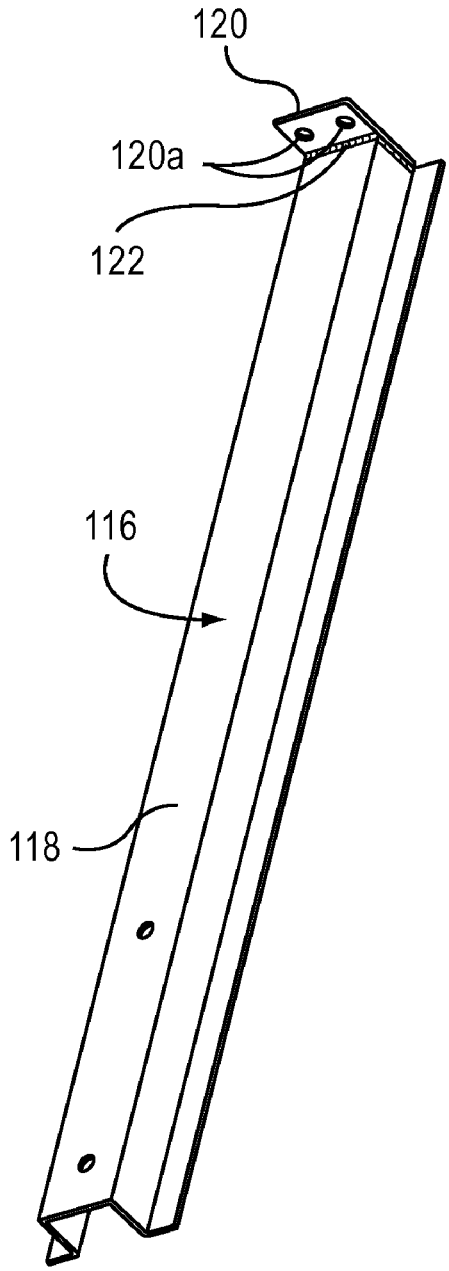
FIG.2 PRIOR ART
FIG. 2 is a downwardly perspective view of the arrangement of the conventional support assembly shown in FIG. 1A.
Figure 3:
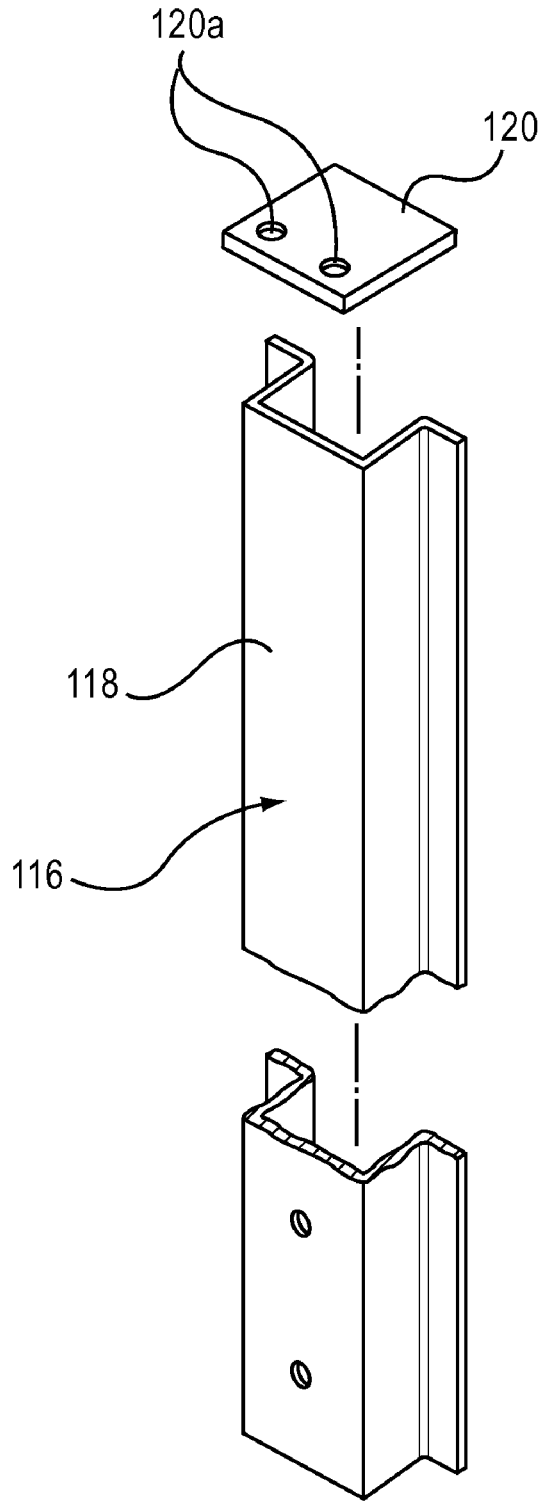
FIG.3 PRIOR ART
FIG. 3 is an upwardly perspective view of the arrangement of conventional support assembly shown in FIGS. 1B and 2
Figure 4:
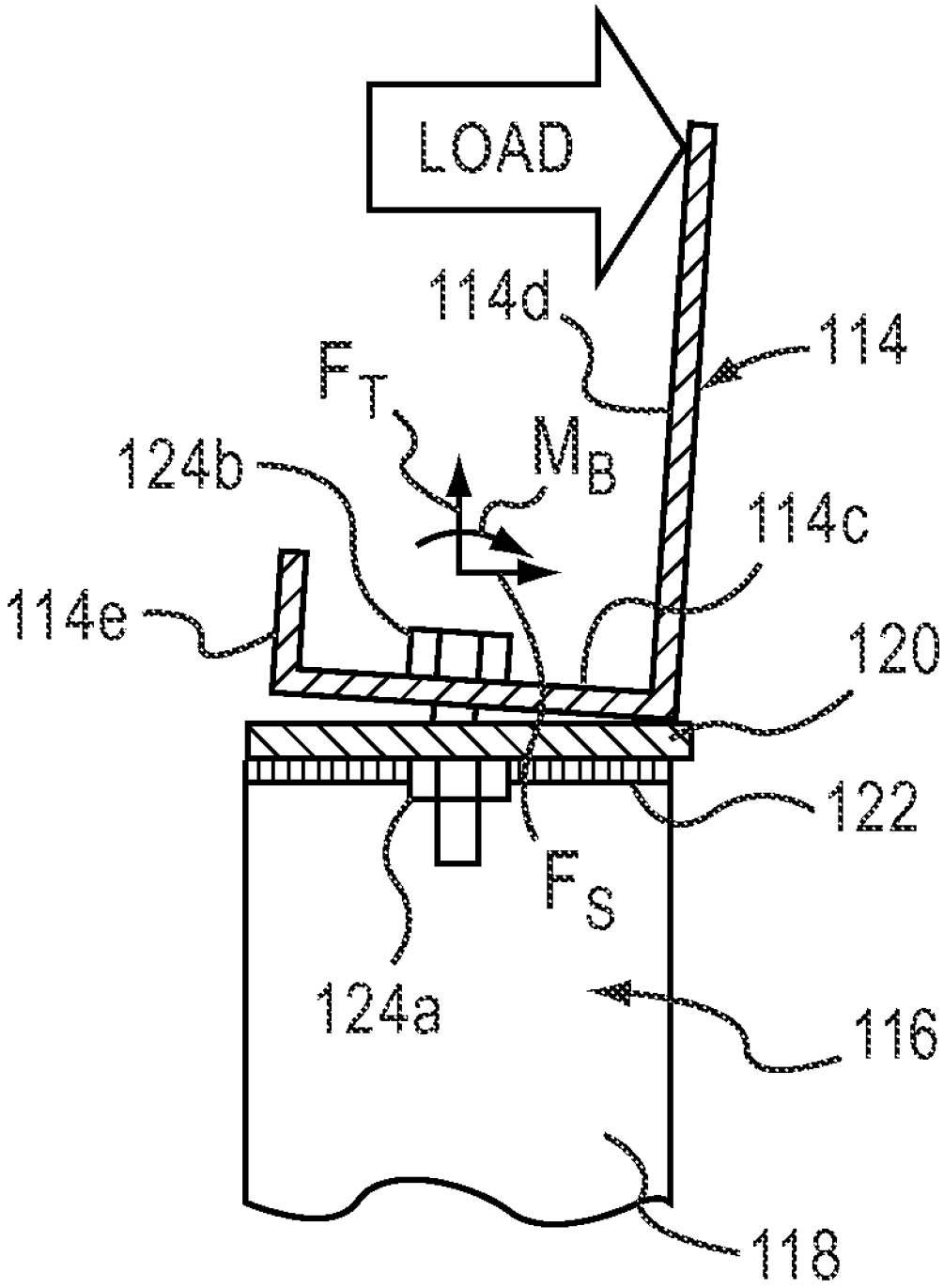
FIG.4 PRIOR ART
FIG. 4 is a side elevational view partially in cross-section taken along line 4-4 in FIG. 1B.
Figure 5:
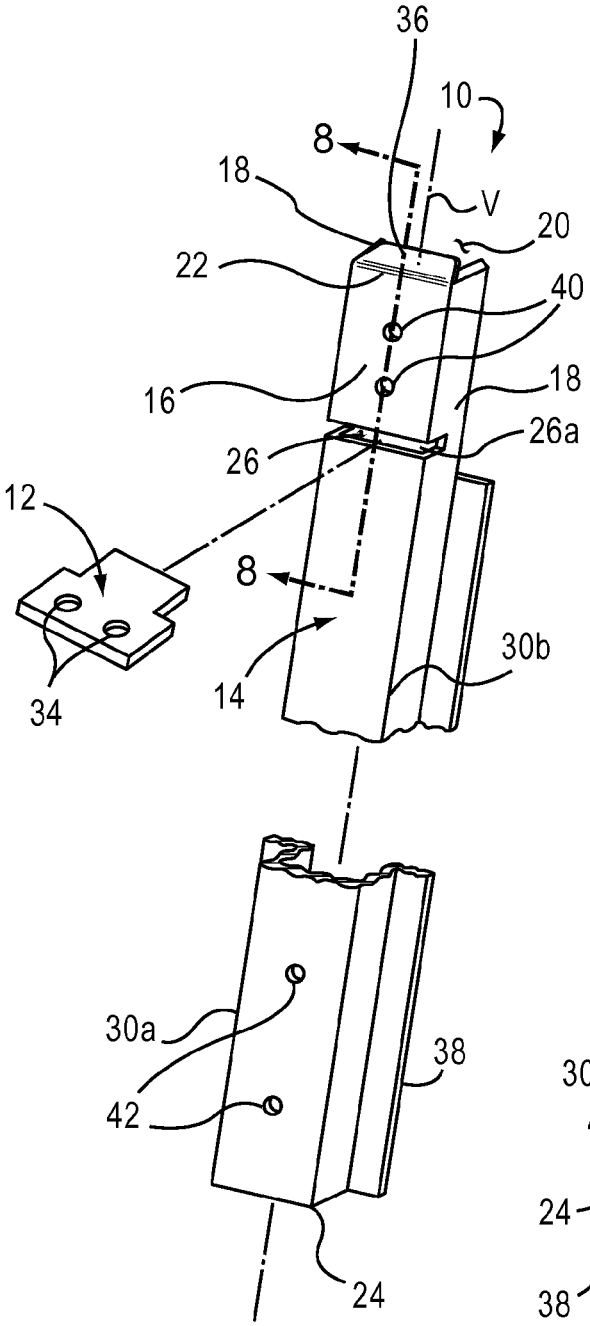
FIG. 5 is a downwardly perspective view of a first exemplary embodiment of a vertical support structure of the present invention.
Figure 6:
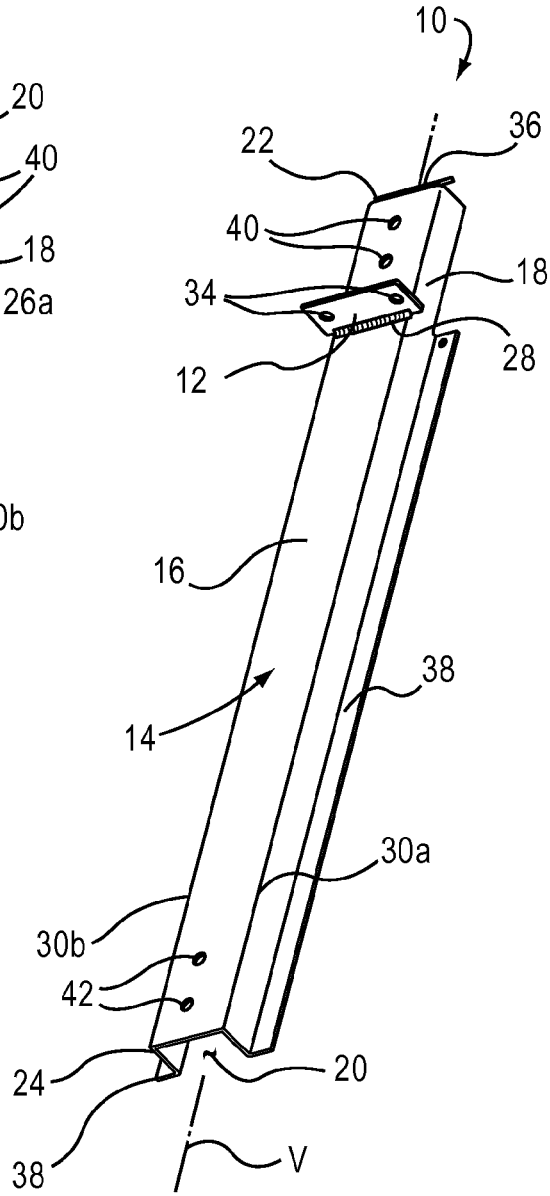
FIG. 6 is an upwardly perspective view of the first exemplary embodiment of a vertical support structure of the present invention in FIG. 5.
Figure 7:
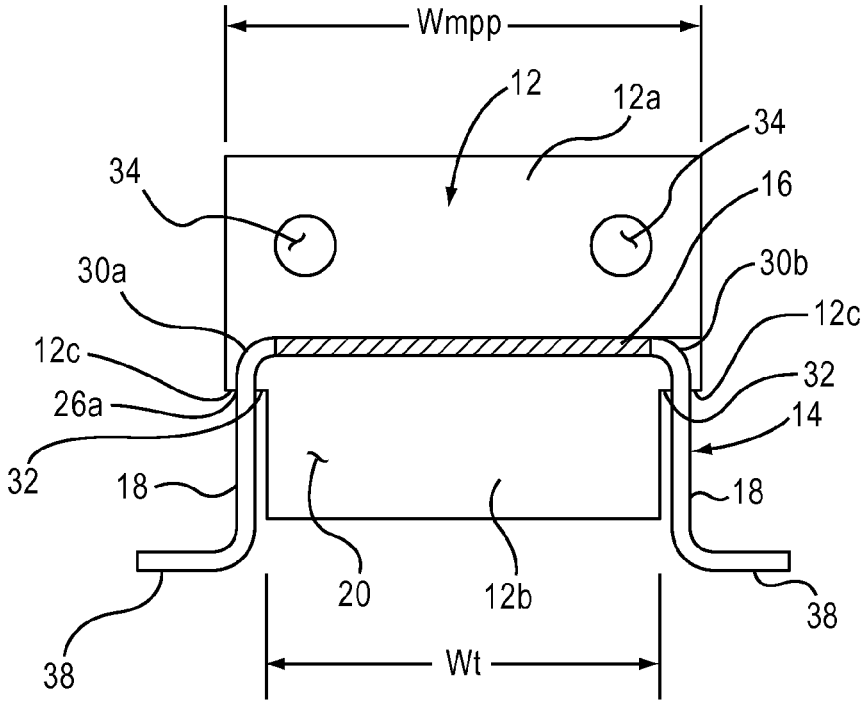
FIG. 7 is a top plan view of the vertical support structure in FIGS. 5 and 6.

A first exemplary embodiment of a vertical support structure 10 of the present invention is introduced in FIGS. 5-9. The vertical support structure 10 includes a mounting plate 12 and a support member fabricated from a stiff yet resilient material such as metal, graphite fiber or other such materials known in the art. The support member 14 extends vertically along a vertical axis V and has a vertically-elongated central panel 16 and a pair of vertically-elongated side panels 18. The each one of the pair of side panels 18 is connected to and extends perpendicularly from the central panel 16 to form a U-shaped-channel 20 as viewed in cross-section as best illustrated in FIG. 7. The support member 14 has a top edge 22 and a bottom edge 24. The top and bottom edges 22 and 24 are disposed vertically apart from and extend horizontally parallel to one another. Also, as best shown in FIG. 5, the support member 14 has a slot 26 formed at least through the central panel 16. The slot 26 is disposed between and extends parallel to the top and bottom edges 22 and 24 respectively.

Figure 8:
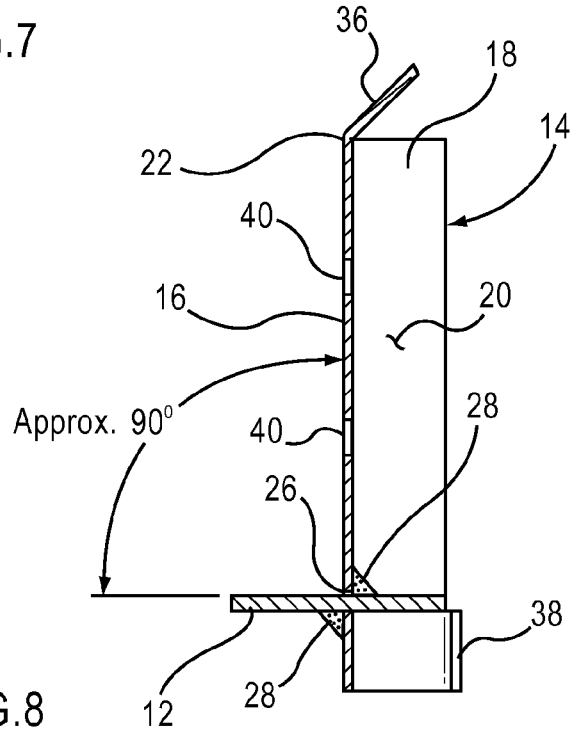
FIG. 8 is a partial side elevational view of the vertical support structure taken along line 8-8 in FIG. 5.
Figure 9:
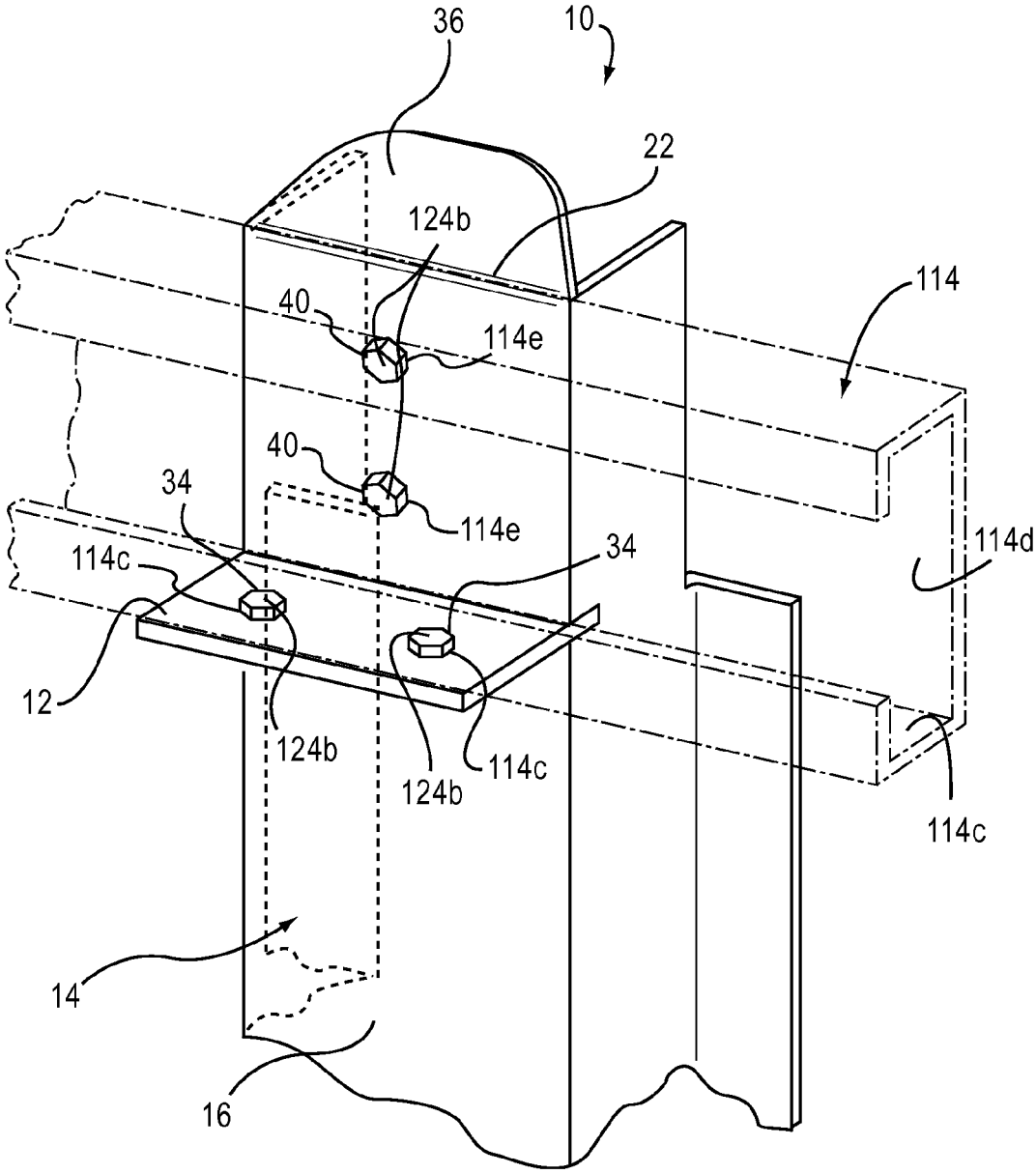
FIG. 9 is a perspective view of the first exemplary embodiment of the vertical support member of the present invention with a cross-beam, drawn in phantom, connected thereto.

In FIGS. 5, 6 and 8, the mounting plate 12 is slidably inserted into the slot 26 in a close-fitting manner (FIG. 8) and is connected to the support member 14, for example only, by a weldment 28. More particularly, the mounting plate 12 is connected at least to the central panel 16 by the weldment 28. As connected, the mounting plate 12 at least partially projects perpendicularly from the central panel 16 away from the U-shaped channel 20 as best shown in FIGS. 6-8. A skilled artisan would appreciate that the mounting plate 12 could be connected to the support member 14 in alternative ways such as by using brackets and fasteners.

With reference to FIG. 5, the slot 26 is disposed away from and is yet positioned adjacent to the top edge 22 of the support member 14. The slot 26 extends completely through the central panel and, although not by way of limitation, extends partially into each one of the pair of side panels 18 as noted by slot portions 26*a* shown in FIGS. 5 and 7.

In FIGS. 5-7, the central panel 16 includes an opposing pair of side edges 30*a* and 30*b* that extend vertically and parallel to one another. The pair of side edges 30*a* and 30*b* interconnect respective ones of the top and bottom edges 22 and 24 respectively forming a rectangular configuration as best illustrated in FIGS. 5 and 6. Respective ones of the pair of side panels 18 are connected to the respective ones of the pair of side edges 30*a* and 30*b* to form an integral construction with the central panel 16.

As best shown in FIGS. 5 and 7, the mounting plate 12 has a rectangularly-shaped mounting plate portion 12*a* and a rectangularly-shaped tongue portion 12*b* integrally connected to each other. The mounting plate portion 12*a* extends horizontally, when the mounting plate 12 is connected to the support member 14, to define a mounting plate portion width Wmpp and the tongue portion 12*b* extends horizontally to define a tongue width Wt as viewed in plan view. Note that the tongue width Wt is less than the mounting plate portion width Wmpp. As shown in FIG. 7, this relationship with regard to the respective widths forms horizontally opposed stepped-down corners 32 where the mounting plate portion 12*a* and the tongue portion 12*b* are integrally connected together. Respective ones of the stepped-down corners 32 define respective stop surfaces 12*c* on the mounting plate portion 12*b* which contact respective ones of the pair of side panels 18. As a result of the stop surfaces 12*c* of the mounting plate 12 contacting the respective ones of the pair of side panels 18 as received in the slot portions 26*a* partially extending into the side panels 18, further insertion of the mounting plate 12 into the slot 26 is prohibited.

Again, with reference to FIG. 7, the mounting plate 12 is partially disposed in the U-shaped channel 20. More specifically, the mounting plate portion 12*a* is partially disposed in the U-shaped channel 20 while the entirety of the tongue portion 12*b* is disposed in the U-shaped channel 20.

In FIGS. 5-7, the mounting plate portion 12*a* of the mounting plate 12 includes two mounting plate through holes 34. However, one of ordinary skill in the art would appreciate that the mounting plate portion 12*a* includes at least one mounting plate through hole extending through the mounting plate 12.

In FIGS. 5, 6 and 8, the vertical support structure 10 of the present invention also include a guide element 36. The guide element 36 is integrally connected to the top edge 22 of the central panel 16. As best illustrated in FIG. 8, the guide element 36 extends upwardly and inwardly toward the U-shaped channel 20. Additionally and particularly with reference to FIGS. 6 and 7, the vertical support structure 10 of the present invention includes a pair of vertically-extending end panels 38. Respective ones of the pair of end panels 38 are connected to and extend perpendicularly from the respective ones of the side panels 18, thereby rendering the support member 14, as viewed in cross-section as a generally square-wave configuration. By way of example only and not by way of limitation, the respective end panels 38 extend from the bottom edge 24 and terminate adjacent the slot 26. In other words, the respective end panels 38 do not necessarily terminate at or adjacent the top edge 20.

Furthermore, the central panel 16 of the support member 14 includes a pair of central panel through holes 40 that are disposed between the slot 26 and the top edge 22. However, one of ordinary skill in the art would appreciate that at least one central panel through hole 40 can be formed through the central panel 16 without departing from the spirit of the invention. And, by way of example only and not by way of limitation, the central panel 16 includes a pair of central panel bottom through holes 42 locate adjacent the bottom edge 24.

The first exemplary embodiment of the vertical support structure 10 of the present invention is adapted for connecting the cross-beam 114 thereto. The cross-beam 114 has at least one flange 114*c* and a web 114*d* connected perpendicularly to the at least one flange 114*c*. The at least one flange 114*c* has at least one cross-beam flange hole 114*b* formed therethrough and the web has at least one cross-beam web hole 114*e* formed therethrough. The vertical support structure 10 includes a plurality of conventional fasteners such as bolts 124*b* and nuts (not shown), the mounting plate 12 having at least one mounting plate through hole 34 formed therethrough and the a support member 14 as described hereinabove.

The mounting plate 12 is connected to the support member as described above. The central panel through holes 40 are disposed between the mounting plate 12 and the top edge 22 such that, when the cross-beam 114 rests on the mounting plate 12, the central panel through holes 40 and the at least one cross-beam web hole 114*e* correspond to each other and the mounting plate through holes 34 and the cross-beam flange holes 114*c* correspond to each other so that respective ones of the fasteners can extend therethrough to connect the web 114*d* to the central panel 16 and to connect the flange 114*c* to the mounting plate 12.

Figure 10:
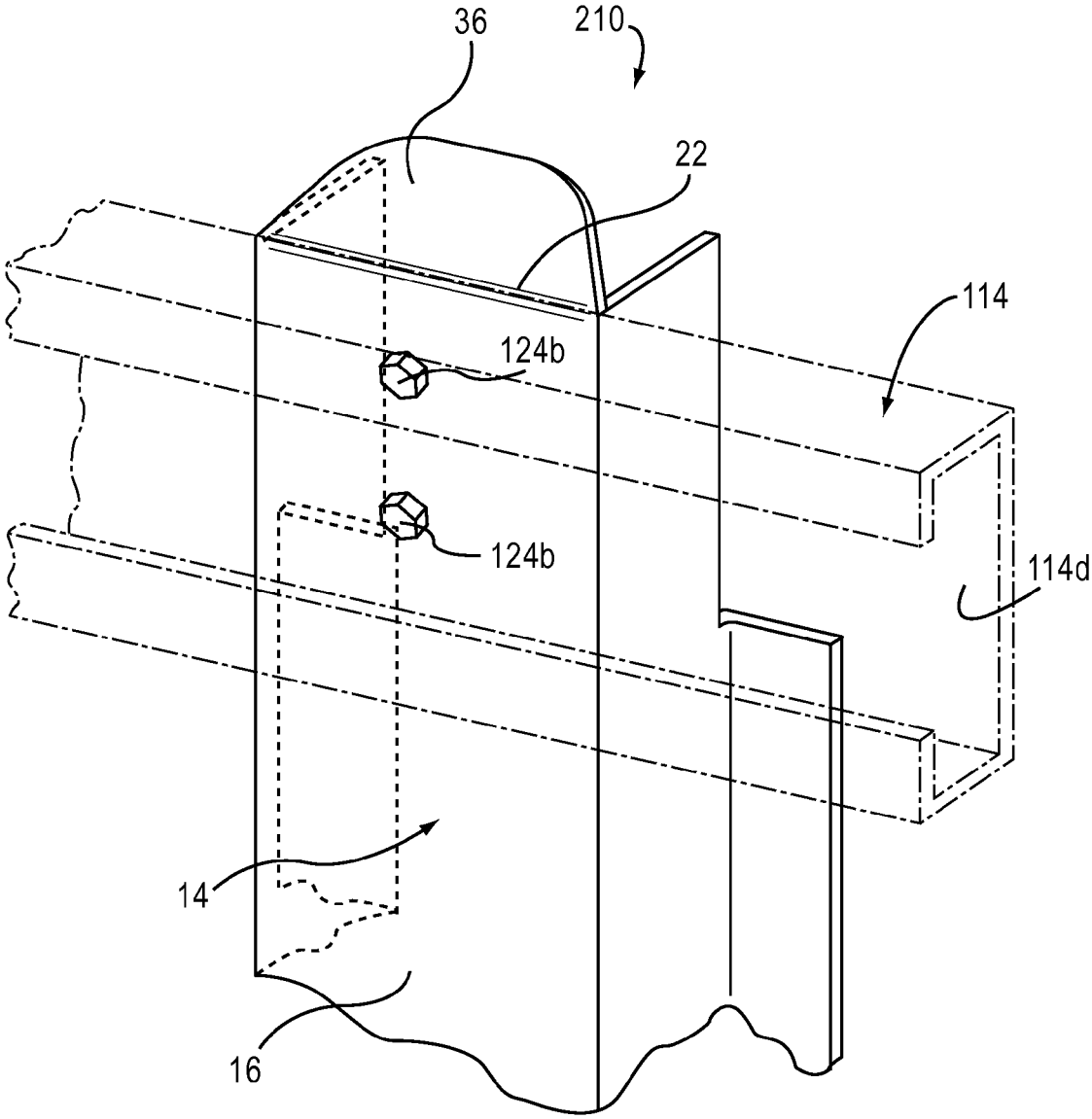
FIG. 10 is a perspective view of a second exemplary embodiment of the vertical support member of the present invention with a cross-beam, drawn in phantom, connected thereto.

A second exemplary embodiment of a vertical support structure 210 of the present invention is introduced in FIG. 10. In this second exemplary embodiment of the present invention, the vertical support structure 210 is substantially similar to the first exemplary embodiment of the vertical support structure 10 of the present invention described above except that the vertical support structure 210 does not include the mounting plate 12. Specifically, the cross-beam 114 is fastened to the vertical support structure 210 with conventional fasteners such as conventional nuts (not shown) and bolts 124*b*.

Furthermore, the term "perpendicularly" recited herein is used in a general descriptive sense only and shall be construed to mean "approximately perpendicularly" or "generally perpendicularly". This term is intended to provide an accurate description of the present invention but should not be construed to limit the invention to precisely an angle of 90°. A skilled artisan would appreciate that "perpendicularly" shall be understood as a generally descriptive term only and not a precise angle.

A skilled artisan would appreciate that the vertical support structure of the present invention reduces the shear $F_S$ and tension $F_T$ forces along with the bending moment $M_B$, generated during seismic events and/or in windy conditions, on the nuts and bolts fastening the flange of the cross-beam to the mounting plate by redistributing the load away from the nuts and bolts, directly into the vertical support structure. Also, a skilled artisan would appreciate that the vertical support structure of the present invention provides enhanced support for cross-beams in a heat exchanger as a result of the vertical support structure itself providing joint stiffness that carries some of the load directly rather than the nuts and bolts carrying all of the load as in the prior art described above.

The present invention, may, however, be embodied in various different forms and should not be construed as limited to the exemplary embodiments set forth herein; rather, these exemplary embodiments are provided so that this disclosure will be thorough and complete and will fully convey the scope of the present invention to those skilled in the art.

What is claimed is:

1. A vertical support structure, comprising:

a mounting plate; and a support member extending vertically along a vertical axis and having a vertically-elongated central panel and a pair of vertically-elongated side panels connected to and extending perpendicularly from the central panel to form a U-shaped-channel as viewed in cross-section, the support member having a top edge and a bottom edge disposed vertically apart from and extending horizontally parallel to one another, the support member having a slot formed at least through the central panel, the slot disposed between and extending parallel to the top and bottom edges, wherein the mounting plate has a rectangularly-shaped mounting plate portion and a rectangularly-shaped tongue portion integrally connected to each other, wherein the mounting plate is slidably inserted into the slot in a close-fitting manner and is connected to the support member such that the mounting plate at least partially projects perpendicularly from the central panel away from the U-shaped channel, and wherein the mounting plate portion extends horizontally to define a mounting plate portion width and the tongue portion extends horizontally to define a tongue width, the tongue width being less than the mounting plate portion width to form horizontally opposed stepped-down corners where the mounting plate portion and the tongue portion are integrally connected together.

2. A vertical support structure according to claim 1, wherein the slot is disposed away from yet adjacent to the top edge of the support member.

3. A vertical support structure according to claim 1, wherein at least one of the mounting plate and the support member is fabricated from a stiff yet resilient material.

4. A vertical support structure according to claim 1, wherein the central panel includes an opposing pair of side edges extending vertically and parallel to one another, the pair of side edges interconnect respective ones of the top and bottom edges forming a rectangular configuration, respective ones of the pair of side panels are connected to respective ones of the pair of side edges to form an integral construction with the central panel.

5. A vertical support structure according to claim 1, wherein the mounting plate is partially disposed in the U-shaped channel.

6. A vertical support structure according to claim 1, wherein the mounting plate is connected to the central panel by at least one weldment.

7. A vertical support structure according to claim 1, wherein the slot is disposed away from yet adjacent to the top edge of the support member such that respective ones of the stepped-down corners define respective stop surfaces on the mounting plate portion which contact respective ones of the pair of side panels thereby prohibiting further insertion of the mounting plate into the slot.

8. A vertical support structure according to claim 7, further comprising a guide element being integrally connected to the top edge of the central panel, the guide element extending upwardly and inwardly toward the U-shaped channel.

9. A vertical support structure according to claim 1, further comprising a pair of vertically-extending end panels, respective ones of the pair of end panels connected to and extending perpendicularly from respective ones of the side panels thereby rendering the support member, as viewed in cross-section as a generally square-wave configuration.

10. A vertical support structure according to claim 1, wherein the central panel includes at least one central panel through hole formed through the central panel, the at least one central panel through hole being disposed between the slot and the top edge.

11. A vertical support structure according to claim 1, wherein the mounting plate is connected to each one of the side panels by the at least one weldment.

12. A vertical support structure, comprising:

a mounting plate; and a support member extending vertically along a vertical axis and having a vertically-elongated central panel and a pair of vertically-elongated side panels connected to and extending perpendicularly from the central panel to form a U-shaped-channel as viewed in cross-section, the support member having a top edge and a bottom edge disposed vertically apart from and extending horizontally parallel to one another, the support member having a slot formed completely across and through the central panel and partially into each one of the pair of side panels from the central panel, the slot disposed between and extending parallel to the top and bottom edges, wherein the mounting plate is slidably inserted into the slot in a close-fitting manner and is connected to the support member such that the mounting plate at least partially projects perpendicularly from the central panel away form the U-shaped channel, wherein the mounting plate has a rectangularly-shaped mounting plate portion and a rectangularly-shaped tongue portion integrally connected to each other and wherein the mounting plate portion includes at least one mounting plate through hole extending through the mounting plate, wherein the mounting plate portion extends horizontally to define a mounting plate portion width and the tongue portion extends horizontally to define a tongue width, the tongue width being less than the mounting plate portion width to form horizontally opposed stepped stepped-down corners where the mounting plate portion and the tongue portion are integrally connected together.

13. A vertical support structure, comprising:

a mounting plate; and a support member extending vertically along a vertical axis and having a vertically-elongated central panel and a pair of vertically-elongated side panels connected to and extending perpendicularly form the central panel to form a U-shaped-connected as viewed in cross-section, the support member having a top edge and a bottom edge disposed vertically apart from and extending horizontally parallel to one another, the support member having a slot formed completely across and through the central panel and partially into each one of the pair of side panels from the central panel, the slot disposed between and extending parallel to the top and bottom edges, wherein the mounting plate is slidably inserted into the slot in a close-fitting manner and is connected to the support member such that the mounting plate at least partially projects perpendicularly from the central panel away from the U-shaped channel, wherein the mounting plate has a rectangularly-shaped mounting plate portion and a rectangularly-shaped tongue portion integrally connected to each other and wherein the mounting plate portion is partially disposed in the U-shaped channel and the entirety of the tongue portion is disposed in the U-shaped channel, wherein the mounting plate portion extends horizontally to define a mounting plate portion width and the tongue portion extends horizontally to define a tongue width, the tongue width being less than the mounting plate portion width to form horizontally opposed stepped stepped-down corners where the mounting plate portion and the tongue portion are integrally connected together.

14. A vertical support structure, comprising:

a support member extending vertically along a vertical axis and having a vertically-elongated central panel and a pair of vertically-elongated side panels connected to and extending perpendicularly from the central panel to form a U-shaped-channel as viewed in cross-section, the support member having a top edge and a bottom edge disposed vertically apart from and extending horizontally parallel to one another, the support member having a slot formed completely across and through the central panel and partially into each one of the pair of side panels from the central panel, the slot disposed between and extending parallel to the top and bottom edges, the support member having at least one cross-beam mounting hole formed therethrough between the slot and the top edge; and a guide element being integrally connected to the top edge of the central panel, the guide element extending upwardly and inwardly toward the U-shaped channel.

15. A vertical support-structure according to claim 14, further comprising a mounting plate slidably insertable into the slot and connected to the support member such that the mounting plate at least partially projects perpendicularly from the central panel away from the U-shaped channel.

16. A vertical support structure according to claim 15, wherein the mounting plate is connected to each one of the side panels by the at least one weldment.

17. A vertical support structure according to claim 14, wherein the slot is disposed away from yet adjacent to the top edge of the support member.

18. A vertical support structure adapted for connecting a cross-beam thereto, the cross-beam having a flange and a web connected perpendicularly to the flange with the flange having at least one cross-beam flange hole formed therethrough and the web having at least one cross-beam web hole formed therethrough, the vertical support structure comprising:

a plurality of fasteners;

a mounting plate having at least one mounting plate hole formed therethrough; and a support member extending vertically along a vertical axis and having a vertically-elongated central panel and a pair of vertically-elongated side panels connected to and extending perpendicularly from the central panel to form a U-shaped-channel as viewed in cross-section, the support member having a top edge and a bottom edge disposed vertically apart from and extending horizontally parallel to one another, the support member having a slot formed at least through the central panel, the slot disposed between and extending parallel to the top and bottom edges, the central panel having a central panel hole formed therethrough, wherein the mounting plate is slidably inserted into the slot in a close-fitting manner and is connected to the support member such that the mounting plate at least partially projects perpendicularly from the central panel away from the U-shaped channel, and wherein the central panel hole is disposed between the mounting plate and the top edge such that, when the cross-beam rests on the mounting plate, the central panel hole and the at least one cross-beam web hole correspond to each other and the at least one mounting plate hole and the at least one cross-beam flange hole correspond to each other so that respective ones of the fasteners can extend therethrough to connect the web to the central panel and to connect the flange to the mounting plate.

* * * * *